United States Patent [19]

Baba et al.

[11] Patent Number: 4,851,192

[45] Date of Patent: Jul. 25, 1989

[54] ALUMINUM ALLOY FOR STRUCTURES WITH HIGH ELECTRICAL RESISTIVITY

[75] Inventors: Yoshio Baba; Teruo Uno; Hideo Yoshida, all of Nagoya, Japan

[73] Assignee: Sumitomo Light Metal Industries, Ltd., Tokyo, Japan

[21] Appl. No.: 161,201

[22] Filed: Feb. 12, 1988

Related U.S. Application Data

[63] Continuation of Ser. No. 562,811, Dec. 19, 1983, abandoned.

[30] Foreign Application Priority Data

Dec. 12, 1982 [JP] Japan ..... 57-232558

[51] Int. Cl.[4] ..... C22C 21/00

[52] U.S. Cl. ..... 420/528; 420/529; 420/533; 420/542; 420/543; 420/545; 420/552; 420/553; 420/554

[58] Field of Search ..... 420/528, 529, 533, 542, 420/543, 545, 552–554; 148/437, 438, 439, 440

[56] References Cited

FOREIGN PATENT DOCUMENTS

| | | |
|---|---|---|
| 1161306 | 4/1958 | France . |
| 331110 | 4/1972 | U.S.S.R. . |
| 870261 | 6/1961 | United Kingdom . |
| 1572587 | 7/1980 | United Kingdom . |
| 2115836 | 9/1983 | United Kingdom . |

*Primary Examiner*—R. Dean

*Attorney, Agent, or Firm*—Browdy and Neimark

[57] ABSTRACT

An aluminum alloy for structures with increased electrical resistivity, consisting essentially of: 1.0–5.0% by weight of Li; one or a plurality of members selected from the group consisting of not more than 0.20% by weight of Ti, 0.05–0.40% by weight of Cr, 0.05–0.30% by weight of Zr, 0.05–0.35% by weight of V and 0.05–0.30% by weight of W; and the balance being aluminum, and impurities which would inevitably be included in the alloy. The aluminum alloy may further include (a) not more than 5.0% by weight of Mn, and/or (b) 0.05–5.0% by weight of Cu and/or 0.05–8.0% by weight of Mg.

50 Claims, No Drawings

ALUMINUM ALLOY FOR STRUCTURES WITH HIGH ELECTRICAL RESISTIVITY

This application is a continuation of application Ser. No. 562,811, filed Dec. 19, 1983, now abandoned.

BACKGROUND OF THE INVENTION

The present invention relates to Al (aluminum) alloys with increased electrical resistivity, usable for structures.

Al alloys in the prior art have been known as alloys which have a low electrical resistivity, that is, an excellent electrical conductivity, and accordingly they have been used as materials for electric wires or the like. In recent years, however, there has been a demand for an Al alloy which has a high electrical resistivity, for new applications thereof as structural materials in the art of technology of linear motor vehicles, nuclear fusion reactors such as a tokamak, etc., because those structural materials are subject to a ferromagnetic field.

As is known, the use of an Al alloy in a ferromagnetic field will cause an induced current to be produced. The magnitude of this induced current increases in proportion to a specific electric conductivity of the Al alloy material. For example, a fixed columnar electrically conductive member of a sufficient length is subjected to a magnetic field H uniformly in its longitudinal direction along the centerline thereof, with the magnetic field H being amplified at a rate of dH/dt, the density J of a current flow through the conductive member in its circumferential direction is obtained by the following formula:

$$J = -\frac{\mu r \sigma}{2} \cdot \frac{dH}{dt}$$

where, $\mu$: magnetic permeability, $\sigma$: specific electric conductivity, and r: radius of the columnar conductive member.

In the meantime, the conductive material in which the current is induced due to the external magnetic field, is subject to a relatively large magnetic force in the direction determined according to the Fleming's Left-hand Rule. To reduce this force, therefore, there is required an Al alloy having an electrical resistivity which is as high as possible.

SUMMARY OF THE INVENTION

In light of the above discussed situation in the art, the present inventors have found the fact, as a result of their research and studies, that an ingenious combination of alloying elements results in an Al alloy which has an increased electrical resistivity, particularly not less than 6.9 $\mu\Omega$cm, more particularly 8.6 $\mu\Omega$cm, and an improved tensile strength which is a property required by structural materials. Thus, the present invention was completed.

Accordingly, it is a primary object of the invention to provide an Al alloy for structures exhibiting an increased electrical resistivity.

Another object of the invention is the provision of a structural material consisting of an Al alloy having a high tensile strength as well as a high electrical resistivity, in particular such structural material that is suitably usable at locations under influence of a ferromagnetic field.

To attain the above objects, ingredients of an Al alloy according to the invention are selected such that the Al alloy consists essentially of: 1.0–5.0% by weight of lithium (Li); one or more elements selected from the group consisting of not more than 0.20% by weight of titanium (Ti), 0.05–0.40% by weight of chromium (Cr), 0.05–0.30% by weight of zirconium (Zr), 0.05–0.35% by weight of vanadium (V) and 0.05–0.30% by weight of tungsten (W); and the balance being Al, and impurities which would inevitably be included in the alloy.

According to another aspect of the invention, the Al alloy may further includes 0–5.0% by weight of manganese (Mn). This Al alloy advantageously exhibits an electrical resistivity of not less than 6.9 $\mu\Omega$cm (equivalent to not more than 25% IACS conductivity), and even 8.6 $\mu\Omega$cm (equivalent to not more than 20% IACS conductivity), and a tensile strength $\sigma_B$ of not less than 15 Kg/mm$^2$, and even 20 kg/mm$^2$ or higher.

According to a further aspect of the invention, the Al alloy may include, in place of an additional element Mn indicated above, 0.05–5.0% by weight of copper (Cu) and/or 0.05–8.0% by weight of magnesium (Mg).

According to the invention, the properties of the Al alloy may be further improved by adding predetermined amounts of copper (Cu) and/or magnesium (Mg) in addition to manganese. More specifically stated, an Al alloy also provided according to a still further aspect of the invention may consist essentially of: 1.0–5.0% by weight of Li and 0.05–5.0% by weight of Cu and/or 0.05–8.0% by weight of Mg; one or more elements selected from the group consisting of 0.05–0.20% by weight of Ti, 0.05–0.40% by weight of Cr, 0.05–0.30% by weight of Zr, 0.05–0.35% by weight of V and 0.05–0.30% by weight of W; not more than 5.0% by weight of Mn; and the balance being Al, and impurities which would inevitably included in the alloy. In this instance, the Al alloy in question provides an electrical resistivity of not less than 6.9 $\mu\Omega$cm and even 8.6 $\mu\Omega$cm, and a tensile strength $\sigma_B$ of not less than 20 kg/mm$^2$, particularly 30 kg/mm$^2$ and even 35 kg/mm$^2$ or higher.

DETAILED DESCRIPTION OF THE INVENTION

The element Li included in the alloy according to the invention is a component which is essential to the alloy for its increased electrical resistivity. For sufficient effect of this element Li on the Al alloy, its content must be at least 1.0% by weight (the contents referred to hereinafter being all based on weight per cent). If the Li content is less than this lower limit, the strength of the Al alloy obtained is reduced, and an increase in electrical resistivity of the alloy may not be obtained as intended. On the other hand, an excessive content of Li will tend to cause the associated Li compounds to be precipitated on the grain boundaries, thereby leading to the possibility of decrease in toughness of the alloy and giving rise to a problem of difficulty in rolling the obtained alloy material. For this reason, the upper limit of the Li content is set at 5.0%. Preferably, the range of the Li content is held between 1.0% and 3.0% for better accomplishment of the objects of the invention.

Other alloying elements Ti, Cr, Zr, V and W are employed as ingredients to increase the electrical resistivity of the alloy and refine the alloy for reducing its grain size, whereby an ingot obtained from a cast molten metal of the instant Al alloy material is provided with a metallurgical structure of fine particles. This grain refinement of the alloy composition renders the Al alloy the properties which are desired on structural materials. However, the proportions of those alloying elements must be held within the following ranges: Ti=not more than 0.20%, preferably not more than 0.06%; Cr=0.05–0.40%, preferably 0.05–0.20%; Zr=0.05–0.30%, preferably 0.05–0.20%; V=0.05–0.35%, preferably 0.05–0.20%; and W=0.05–0.30%, preferably 0.05–0.15%. The use of those elements in excess of the above upper limits will result in the formation of intermetallic compounds which are crystallized out of the alloy, thereby affecting the toughness of the alloy. As previously indicated, these five alloying elements are usable alone or in combination of two or more of the five elements.

The Al alloy described above may include 0.01–0.3% by weight of bismuth (Bi) for improvement in hot-workability of the alloy, and/or 1–100 ppm by weight of beryllium (Be) for prevention of oxidation of the molten metal during casting and for improvement in castability of the Al alloy.

Another alloying element Mn not only serves, like the above mentioned five elements Ti, Cr, etc., to increase the electrical resistivity of the alloy and reduce the grain size of the same, but also serves to strengthen the alloy. This alloying element Mn is used in an amount ranging from 0.05 to 2.0%. It is also noted that the use of Mn in excess of 2.0% will adversely affect the toughness of the alloy obtained.

However, when the Al alloy of the invention is employed as materials for structures such as a nuclear fusion reactor or the like wherein a residual radioactivity is a matter of concern, the alloy shall not include the element Mn, in view of the recognized adverse influence of the Mn on the amount of the residual radioactivity, that is, the 1% addition of the Mn in the Al alloy will cause a dose rate of $10^{-1}$ mrem/hr one year after a D-T shot, and this dose rate is reduced to only about one tenth thereof even when as many as five years have passed since the D-T shot.

The alloying element(s) Mg and/or Cu which is (are) also included in addition to the other alloying elements discussed hitherto, is (are) an element (elements) serving effectively to increase the electrical resistivity of the Al alloy of the invention. An excessive content of such elements will make the obtained Al alloy difficult to be processed by means of rolling or extrusion. Thus, the proportions of Mn and Cu in the Al alloy are held in the specified ranges. That is, the range of Cu is between 0.05 and 5.0%, preferably 0.15–4.5%, more preferably 0.5–4.0%, and that of Mg is between 0.05 and 8.0%, preferably 0.5–6.5%, more preferably 2.0–6.0%. It is noted that the Mg contributes more than the Cu to the improvement in strength of the Al alloy in question. The tensile strength $\sigma_B$ of the Al alloy is about 20–35 kg/mm$^2$ when the alloy includes the Cu in the specified range of content but no Mg, while that of the alloy which includes the Mg in the specified range but no Cu is improved to at least 35 kg/mm$^2$, and possibly to as high as 40 kg/mm$^2$ or even higher. As indicated above, these alloying elements Cu and Mg are added alone or in combination thereof, as needed.

The Al alloy comprising the above discussed alloying elements according to the instant invention is first prepared in the form of a molten aluminum alloy which is then cast, with a known conventional DC casting method, into an intended ingot of the Al alloy for use as structural materials for a wide variety of applications. Subsequently, the cast alloy ingot is subjected to a heat treatment, so-called homogenizing (soaking) treatment for homogenizing the cast structure (alloying elements of the alloy). Successively, the ingot is hot- and cold-rolled with ordinary methods, and further subjected, as needed, to known treatments such as solution treatment and aging. Thus, the ingot is processed to produce the structural material to meet the specific application.

In the case where a structural material is fabricated of an Al alloy in the form of powders which are produced by means of a rapid cooling of a molten Al alloy with such methods as rolling, atomization through ultrasonic nozzles, or centrifugal method, it is possible that some elements such as Mn are positively solutioned in a relatively large amount in the Al alloy. The powders thus obtained through the rapid cooling method may be formed into a powdered article through compaction followed by degasing and extrusion, or through forging or rolling. The Al alloy article obtained with this method is advantageous for its further increased electrical resistivity.

The thus obtained Al alloy is given a significantly increased electrical resistivity, particularly not less than 6.9 $\mu\Omega$cm (not more than 25% IACS conductivity), more particularly 8.6 $\mu\Omega$cm (not more than 20% IACS conductivity), and an enhanced tensile strength $\sigma_B$ of not less than 20 kg/mm$^2$, particularly 30 kg/mm$^2$ and even possibly 35 kg/mm$^2$, thus demonstrating improved electrical and mechanical characteristics, which permit the Al alloy of the invention to serve advantageously as structural materials for linear motor vehicles and nuclear fusion reactors, for example, which are subject to a ferromagnetic field. An Al alloy of the invention which does not include Mn is particularly advantageous as structural materials for vacuum vessels and coil frames of a nuclear fusion reactor, because this Al alloy is capable of decreasing the level of residue of radioactivity given to the material upon neutron irradiation during a D-T burning.

The invention will be understood more readily with reference to the following examples; however, these examples are intended to illustrate the invention and are not to be construed to limit the scope of the invention.

EXAMPLE 1

Materials for different Al-Li alloys consisting of elements or ingredients indicated in Table 1 were melted, in an atmosphere of Ar (argon), with aluminum chloride flux added, and each mass of the melt was cast into a 175×175 mm-square rectangular ingot of a 30 mm thickness. This ingot was then homogenized through heat treatment at 450° C. in an adjusted atmosphere, and hot-rolled at 380° C. into a sheet having a thickness of 4 mm. Subsequently, this hot-rolled sheet was cold-rolled to a thickness of 2 mm.

The cold-rolled sheets were cut to provide test samples for examination of electrical resistivity and tensile strength. The test samples were subjected to a solution heat treatment at about 500° C. and finally to an age-hardening treatment at 100–200° C.

The obtained test samples of the various alloy compositions were tested for their electrical characteristics and tensile strength. The measurements of the individual samples are listed in Table 2. The electrical characteristics were examined in terms of the IACS (International Annealed Copper Standard) percent conductivity, and the electrical resistivity based on the ASTM (American Society for Testing Materials) B-193 Specification. This resistivity was obtained by converting the measured IACS percent conductivity. The tensile strength was measured based on the JIS (Japan Industrial Standard) Z-2241 Specification. The IACS conductivity percent is the reciprocal of the resistivity (ohm-centimeters). For example, 20% IACS conductivity is equivalent to 8.6 μΩcm.

The Al alloys containing the alloying element(s) Li and/or Cu in excess of the respective specified upper limit of the invention, were found difficult to be processed, i.e., they tended to crack during a forming process. Consequently, the measurements of the electrical characteristics and tensile strength could not be made. No tests were effected on samples which contain the other alloying elements Ti, Mn, Cr, Zr, V, W in an amount exceeding the specified limits, because there exists the second phase particle, i.e., giant intermetallic compounds of Al-Ti, Al-Mn, Al-Cr, Al-Zr, Al-V, Al-W, etc. in those alloy.

Sample No. 20 which contains Mn in a relatively large amount, was obtained by compacting, degasing and extruding flake powders which had been prepared from a molten alloy of the specified composition through solidification by a rapid cooling method (twin-roll method). It was found that such rapid cooling method permitted an Al alloy to contain a maximum of about 5% Mn in the state of solid solution.

The evaluations of the detected residual radioactivity levels indicated in Table 2 were made according to the measurements of the residual level detected one month after the D-T reaction. The circle marks in the table indicate the range of the residue (less than $10^{-2}$mrem/hr) in which a radioactivity level in the vicinity of the Al alloy material in question is substantially non-harmful to the human being. The triangle marks indicate the range of the residue ($10^{-1}$ to $10^{-2}$ mrem/hr) in which the radioactive effect on the human being should be taken into consideration. The cross mark indicate the range (higher than $10^{-1}$ mrem/hr) in which a radioactivity level is so high that the human being is not able to gain access to, for example, a vacuum vessel of a nuclear fusion reactor made of the Al alloy in question.

As is apparent from the results in Table 2, Al alloy Samples Nos. 1 through 22 including the alloying elements in the specified ranges according to the invention, exhibit improved, excellent characteristics as required by structural materials, that is, not higher than 20% IACS conductivity, i.e., electrical resistivity of not less than 8.6 μΩcm, and tensile strength of not less than 20 kg/mm$^2$ (except Sample No. 19). Sample No. 19 the tensile strength of which is 17.3 kg/mm$^2$, is also considered sufficiently strong as a structural material.

TABLE 1

| Sample No. | Contents (weight %) of Ingredients | | | | | | | | |
|---|---|---|---|---|---|---|---|---|---|
| | Li | Cu | Mn | Cr | Ti | Zr | V | W | Al |
| 1 | 2.9 | 2.1 | 0.32 | 0.10 | 0.06 | 0.15 | 0.10 | — | Balance |
| 2 | 2.7 | 2.2 | — | 0.10 | 0.06 | 0.16 | 0.10 | — | " |
| 3 | 2.8 | 2.2 | 0.31 | 0.10 | 0.06 | 0.16 | — | — | " |
| 4 | 2.7 | 2.1 | 0.31 | 0.11 | 0.06 | — | 0.10 | — | " |
| 5 | 2.6 | 2.3 | 0.32 | — | 0.06 | 0.16 | 0.10 | — | " |
| 6 | 2.9 | 2.4 | 0.31 | 0.10 | — | 0.16 | 0.10 | — | " |
| 7 | 3.2 | 2.1 | 0.31 | 0.10 | 0.06 | — | — | 0.11 | " |
| 8 | 2.7 | 2.5 | 0.30 | 0.10 | 0.01 | 0.17 | — | — | " |
| 9 | 2.8 | 2.2 | 0.30 | 0.10 | — | — | 0.11 | — | " |
| 10 | 3.1 | 2.1 | 0.31 | — | 0.06 | 0.17 | — | — | " |
| 11 | 3.0 | 2.4 | 0.31 | — | 0.06 | — | 0.10 | — | " |
| 12 | 3.1 | 2.1 | 0.30 | — | 0.01 | 0.20 | 0.15 | — | " |
| 13 | 2.8 | 2.1 | 0.30 | 0.22 | — | — | — | — | " |
| 14 | 2.7 | 2.0 | 0.31 | — | 0.15 | — | — | — | " |
| 15 | 2.7 | 2.3 | 0.31 | — | 0.02 | 0.18 | — | — | " |
| 16 | 3.2 | 2.0 | 0.31 | — | — | — | — | 0.15 | " |
| 17 | 3.1 | 0.8 | 0.25 | 0.09 | 0.06 | 0.16 | 0.11 | — | " |
| 18 | 4.0 | — | — | 0.10 | 0.06 | 0.15 | 0.11 | — | " |
| 19 | 1.5 | — | — | 0.20 | 0.06 | 0.16 | 0.10 | — | " |
| 20 | 3.2 | — | 2.6 | — | — | 0.10 | — | — | " |
| 21* | 2.9 | — | — | 0.11 | 0.02 | 0.12 | — | — | " |
| 22* | 2.7 | 2.4 | — | 0.10 | 0.02 | 0.13 | — | — | " |
| 23 | 3.0 | 5.3 | — | 0.08 | 0.06 | 0.15 | — | — | " |
| 24 | 5.2 | 2.2 | — | 0.15 | 0.06 | 0.18 | — | — | " |
| 25 | 3.2 | — | — | 0.45 | — | — | — | — | " |
| 26 | 3.2 | — | — | — | — | 0.35 | — | — | " |
| 27 | 3.1 | — | — | — | — | — | — | 0.41 | " |
| 28 | 0.8 | — | — | 0.10 | 0.01 | 0.15 | — | — | " |

*Note:
Sample No. 21 further includes 0.05% of Bi and 5 ppm of Be.
Sample No. 22 further includes 0.08% of Bi and 7 ppm of Be.

TABLE 2

| Sample No. | Processing Method | Electrical Characteristics | | Tensile Strength ($\sigma$B(kg/mm$^2$) | Residual Radioactive level |
|---|---|---|---|---|---|
| | | IACS % | μΩ · cm | | |
| 1 | Rolling | 14.2 | 12.1 | 34.2 | Δ |
| 2 | " | 16.8 | 10.3 | 31.1 | o |
| 3 | " | 14.5 | 11.9 | 33.2 | Δ |
| 4 | " | 14.7 | 11.7 | 32.5 | Δ |
| 5 | " | 14.9 | 11.6 | 32.1 | Δ |
| 6 | " | 14.3 | 12.1 | 34.0 | Δ |
| 7 | " | 14.8 | 11.6 | 31.4 | Δ |
| 8 | " | 14.7 | 11.7 | 32.7 | Δ |
| 9 | " | 14.8 | 11.6 | 31.5 | Δ |
| 10 | " | 15.2 | 11.3 | 32.7 | Δ |
| 11 | " | 15.3 | 11.3 | 31.0 | Δ |
| 12 | " | 15.2 | 11.3 | 32.8 | Δ |
| 13 | " | 14.9 | 11.6 | 32.3 | Δ |
| 14 | " | 15.7 | 11.0 | 31.2 | Δ |
| 15 | " | 15.2 | 11.3 | 32.6 | Δ |
| 16 | " | 15.8 | 10.9 | 31.9 | Δ |
| 17 | " | 17.8 | 9.7 | 28.2 | Δ |
| 18 | " | 14.2 | 12.1 | 30.5 | o |
| 19 | " | 18.6 | 9.3 | 17.3 | o |

TABLE 2-continued

| Sample No. | Electrical Characteristics IACS % | Electrical Characteristics μΩ · cm | Tensile Strength (σB(kg/mm²) | Residual Radioactive level |
|---|---|---|---|---|
| 20 | 13.8 | 12.5 | 32.4 | x |
| 21 | 17.8 | 9.7 | 27.4 | o |
| 22 | 16.9 | 10.2 | 31.6 | Δ |
| 23 | — | — | — | — |
| 24 | — | — | — | — |
| 25 | — | — | — | — |
| 26 | — | — | — | — |
| 27 | — | — | — | — |
| 28 | 22.5 | 7.7 | 14.6 | o |

Samples Nos. 1–22: Al Alloys of the Invention
Samples Nos. 23–28: Comparative Al Alloys

EXAMPLE 2

In the same manner as used in Example 1, materials for different Al-Li-Mg alloys consisting of elements or ingredients indicated in Table 3 were melted, and each mass of the melt was cast into an ingot of predetermined dimensions. This ingot was then heat-treated for homogenization, hot-rolled and then cold-rolled into a sheet of a predetermined thickness. The cold-rolled sheets were cut to provide test samples which were subjected to a solution treatment and finally to an age-hardening treatment. The obtained test samples of the various alloy compositions were tested for their electrical characteristics and tensile strength. The measurements of the individual samples are listed in Table 4. Like Sample No. 20 in Example 1, Sample No. 20 of this Example was obtained from flake powder prepared through solidification by a rapid cooling method.

As is apparent from the results in Table 4, the inclusion of Mg as an element of an Al alloy contributes to improvement in tensile strength of the alloy while the IACS conductivity of not higher than 20% is maintained. More specifically, the Al alloys including Mg exhibit a tensile strength of at least 40 kg/mm², and even not less than 45 kg/mm².

TABLE 1

| Sample No. | Li | Mg | Cu | Mn | Cr | Ti | Zr | V | W | Al |
|---|---|---|---|---|---|---|---|---|---|---|
| | Contents (weight %) of Ingredients | | | | | | | | | |
| 1 | 2.7 | 2.2 | — | 0.31 | 0.10 | 0.06 | 0.15 | 0.10 | — | Balance |
| 2 | 2.8 | 2.3 | — | — | 0.11 | 0.06 | 0.15 | 0.10 | — | " |
| 3 | 2.8 | 2.2 | — | 0.30 | 0.10 | 0.06 | 0.15 | — | — | " |
| 4 | 2.6 | 2.4 | — | 0.30 | 0.10 | 0.06 | — | 0.10 | — | " |
| 5 | 2.7 | 2.1 | — | 0.31 | — | 0.06 | 0.15 | 0.10 | — | " |
| 6 | 2.9 | 2.2 | — | 0.32 | 0.10 | 0.01 | 0.15 | 0.10 | — | " |
| 7 | 2.9 | 2.0 | — | 0.31 | 0.10 | 0.06 | — | — | 0.10 | " |
| 8 | 3.1 | 2.2 | — | 0.31 | 0.11 | 0.01 | 0.16 | — | — | " |
| 9 | 3.0 | 2.2 | — | 0.30 | 0.11 | 0.01 | — | 0.10 | — | " |
| 10 | 3.2 | 2.3 | — | 0.31 | — | 0.06 | 0.15 | — | — | " |
| 11 | 2.8 | 2.1 | — | 0.31 | — | 0.06 | — | 0.10 | — | " |
| 12 | 2.9 | 2.0 | — | 0.31 | — | 0.01 | 0.21 | 0.20 | — | " |
| 13 | 3.0 | 2.3 | — | 0.30 | 0.23 | — | — | — | — | " |
| 14 | 2.7 | 2.0 | — | 0.31 | — | 0.15 | — | — | — | " |
| 15 | 2.9 | 2.0 | — | 0.30 | — | — | 0.20 | — | — | " |
| 16 | 3.1 | 2.1 | — | — | — | — | — | 0.16 | — | " |
| 17 | 2.3 | 4.6 | — | — | — | — | 0.15 | — | — | " |
| 18 | 1.4 | 6.1 | — | — | 0.10 | 0.06 | 0.15 | — | — | " |
| 19 | 2.7 | 2.2 | 2.4 | — | 0.10 | 0.06 | 0.14 | — | — | " |
| 20 | 3.2 | 2.0 | — | 2.5 | — | — | 0.22 | — | — | " |
| 21* | 2.9 | 2.4 | — | — | 0.11 | 0.05 | 0.14 | — | — | " |
| 22 | 2.6 | 8.2 | — | — | 0.11 | 0.05 | 0.15 | — | — | " |
| 23 | 5.2 | 2.5 | — | — | 0.10 | 0.06 | 0.15 | — | — | " |
| 24 | 3.1 | 2.4 | — | — | 0.45 | 0.06 | — | — | — | " |
| 25 | 3.4 | 2.2 | — | — | — | 0.05 | 0.35 | — | — | " |
| 26 | 3.0 | 2.1 | — | — | — | 0.05 | — | | 0.40 | " |

*Note:
Sample No. 21 further includes 0.06% of Bi and 4 ppm of Be.

TABLE 4

| Sample No. | Processing Method | Electrical Characteristics IACS % | Electrical Characteristics μΩ · cm | Tensile Strength (σB(kg/mm²) | Residual Radioactive level |
|---|---|---|---|---|---|
| 1 | Rolling | 15.1 | 11.4 | 48.5 | Δ |
| 2 | " | 17.0 | 10.1 | 43.1 | o |
| 3 | " | 14.9 | 11.6 | 46.2 | Δ |
| 4 | " | 15.2 | 11.3 | 45.4 | Δ |
| 5 | " | 14.8 | 11.6 | 45.8 | Δ |
| 6 | " | 14.7 | 11.7 | 46.9 | Δ |
| 7 | " | 15.1 | 11.4 | 45.1 | Δ |
| 8 | " | 14.8 | 11.6 | 46.7 | Δ |
| 9 | " | 15.4 | 11.2 | 45.0 | Δ |
| 10 | " | 15.3 | 11.3 | 46.4 | Δ |
| 11 | " | 16.2 | 10.6 | 45.1 | Δ |
| 12 | " | 14.9 | 11.6 | 46.3 | Δ |
| 13 | " | 15.1 | 11.4 | 46.0 | Δ |
| 14 | " | 15.8 | 10.9 | 44.8 | Δ |
| 15 | " | 15.0 | 11.5 | 46.5 | Δ |
| 16 | " | 16.1 | 10.7 | 45.6 | o |
| 17 | " | 13.8 | 12.5 | 50.4 | o |
| 18 | " | 13.4 | 12.9 | 51.2 | o |
| 19 | " | 14.2 | 12.1 | 51.9 | o |
| 20 | Extrusion | 12.9 | 13.4 | 47.2 | x |
| 21 | Rolling | 16.0 | 10.8 | 45.8 | o |
| 22 | (Cracked in | — | — | — | — |
| 23 | hot-rolling) | — | — | — | — |
| 24 | (Cracked in | — | — | — | — |
| 25 | processing) | — | — | — | — |
| 26 | " | — | — | — | — |

Samples Nos. 1–21: Al Alloys of the Invention
Samples Nos. 22–26: Comparative Al Alloys

What is claimed is:

1. An aluminum alloy for structures with increased electrical resistivity, consisting essentially of: 1.4–5.0% by weight of Li; one or more elements selected from the group consisting of 0.05–0.40% by weight of Cr, 0.05–0.35% by weight of V and 0.05–0.30% by weight of W; and the balance being aluminum, and impurities which would inevitably be included in the alloy.

2. An aluminum alloy as recited in claim 1, wherein the content of said Li is in the range of 1.4–3.0% by weight.

3. An aluminum alloy as recited in claim 1, further including 0.01–0.30% by weight of Bi or 1–100 ppm by weight of Be.

4. An aluminum alloy as recited in claim 1, wherein the tensile strength is not less than 20 kg/mm$^2$.

5. An aluminum alloy for structures with increased electrical resistivity, consisting essentially of: 1.4–5.0% by weight of Li; one or more elements selected from the group consisting of 0.05–0.40% by weight of Cr, 0.05–0.35% by weight of V and 0.05–0.30% by weight of W; not more than 5.0% by weight of Mn; and the balance being aluminum, and impurities which would inevitably be included in the alloy.

6. An aluminum alloy as recited in claim 5, wherein the content of said Li is in the range of 1.4–3.0% by weight.

7. An aluminum alloy as recited in claim 5, wherein the content of said Mn is in the range of 0.05–2.0% by weight.

8. An aluminum alloy as recited in claim 5, further including 0.01–0.30% by weight of Bi or 1–100 ppm by weight of Be.

9. An aluminum alloy as recited in claim 5, wherein the tensile strength is not less than 20 kg/mm$^2$.

10. An aluminum alloy for structures with increased electrical resistivity, consisting essentially of: 1.4–5.0% by weight of Li; 0.05–5.0% by weight of Cu; 0.05–8.0% by weight of Mg; one or more elements selected from the group consisting of not more than 0.20% by weight of Ti, 0.05–0.35% by weight of V and 0.05–0.30% by weight of W; and the balance being aluminum, and impurities which would inevitably be included in the alloy.

11. An aluminum alloy as recited in claim 10, wherein the content of said Li is in the range of 1.4–3.0% by weight.

12. An aluminum alloy as recited in claim 10, further including 0.01–0.30% by weight of Bi or 1–100 ppm by weight of Be.

13. An aluminum alloy as recited in claim 10, wherein the tensile strength is not less than 20 kg/mm$^2$.

14. An aluminum alloy as recited in claim 10, wherein the content of said Cu is in the range of 0.5–4% by weight.

15. An aluminum alloy as recited in claim 10, wherein the content of said Mg is in the range of 0.5–6.5% by weight.

16. An aluminum alloy for structures with increased electrical resistivity, consisting essentially of: 1.4–5.0% by weight of Li; 0.05–5.0% by weight of Cu; 0.05–8.0% by weight of Mg; one or more elements selected from the group consisting of not more than 0.20% by weight of Ti, 0.05–0.35% by weight of V and 0.05–0.30% by weight of W; not more than 5.0% by weight of Mn; and the balance being aluminum, and impurities which would inevitably be included in the alloy.

17. An aluminum alloy as recited in claim 16, wherein the content of said Li is in the range of 1.4–3.0% by weight.

18. An aluminum alloy as recited in claim 16, wherein the content of said Mn is in the range of 0.05–2.0% by weight.

19. An aluminum alloy as recited in claim 16, further including 0.01–0.30% by weight of Bi or 1–100 ppm by weight of Be.

20. An aluminum alloy as recited in claim 16, wherein the tensile strength is not less than 20 kg/mm$^2$.

21. An aluminum alloy as recited in claim 16, wherein the content of said Cu is in the range of 0.5–4% by weight.

22. An aluminum alloy as recited in claim 16, wherein the content of said Mg is in the range of 0.5–6.5% by weight.

23. An aluminum alloy for structures with increased electrical resistivity, consisting essentially of: 1.4–5.0% by weight of Li; 0.05–8.0% by weight of Mg; one or more elements selected from the group consisting of not more than 0.20% by weight of Ti, 0.05–0.40% by weight of Cr, 0.05–0.30% by weight of Zr, 0.05–0.35% by weight of V and 0.05–0.30% by weight of W; and the balance being aluminum, and impurities which would inevitably be included in the alloy, the aluminum alloy having an electrical resistivity of at least 8.67 $\mu\Omega$cm.

24. An aluminum alloy as recited in claim 23, wherein the content of said Li is in the range of 1.4–3.0% by weight.

25. An aluminum alloy as recited in claim 23, further including 0.01–0.30% by weight of Bi or 1–100 ppm by weight of Be.

26. An aluminum alloy as recited in claim 23, wherein the tensile strength is not less than 20 kg/mm$^2$.

27. An aluminum alloy as recited in claim 23, wherein the content of said Mg is in the range of 0.5–6.5% by weight.

28. An aluminum alloy for structures with increased electrical resistivity, consisting essentially of: 1.4–5.0% by weight of Li; 0.05–8.0% by weight of Mg; one or more elements selected from the group consisting of not more than 0.20% by weight of Ti, 0.05–0.40% by weight of Cr, 0.05–0.30% by weight of Zr, 0.05–0.35% by weight of V and 0.05–0.30% by weight of W; not more than 5.0% by weight of Mn; and the balance being aluminum and impurities which would inevitably be included in the alloy, said aluminum alloy having an electrical resistivity of at least 8.6 $\mu\Omega$cm.

29. An aluminum alloy as recited in claim 28, wherein the content of said Li is in the range of 1.4–3.0% by weight.

30. An aluminum alloy as recited in claim 28, wherein the content of said Mn is in the range of 0.05–2.0% by weight.

31. An aluminum alloy as recited in claim 28, further including 0.01–0.30% by weight of Bi or 1–100 ppm by weight of Be.

32. An aluminum alloy as recited in claim 28, wherein the tensile strength is not less than 20 kg/mm$^2$.

33. An aluminum alloy as recited in claim 28, wherein the content of said Mg is in the range of 0.5–6.5% by weight.

34. An aluminum alloy for structures with increased electrical resistivity, consisting essentially of:

1.0–5.0% by weight of Li;

0.05–5.50% by weight of Cu or 0.05–5.0% by weight of Mg, said Li being present in an amount greater than the amount of said Mg;

one or more elements selected from the group consisting of not more than 0.20% by weight of Ti, 0.05–0.30% by weight of V and 0.05–0.30% by weight of W;

and the balance being aluminum, and impurities which would inevitably be included in the alloy.

35. An aluminum alloy for structures with increased electrical resistivity, consisting essentially of: 1.0–5.0% by weight of Li; 0.05–5.0% by weight of Cu or 0.05–5.0% by weight of Mg, said Li being present in an amount greater than the amount of said Mg; one or more elements selected from the group consisting of not more than 0.20% by weight of Ti, 0.05–0.35% by weight of V and 0.05–0.30% by weight of W; not more than 5.0% by weight of Mn; and the balance being aluminum, and impurities which would inevitably be included in the alloy.

36. A structural element for a nuclear fusion reactor, comprising a nuclear fusion reactor element of an alloy consisting essentially of:

1.4–5.0% by weight of Li;

one or more elements selected from the group consisting of 0.05–0.40% by weight of Cr, 0.05–0.35% by weight of V and 0.05–0.30% by weight of W;

and the balance being aluminum, and impurities which would inevitably be included in the alloy.

37. The alloy recited in claim 23, wherein said Li is present in an amount greater than the amount of said Mg.

38. The alloy recited in claim 28, wherein said Li is present in an amount greater than the amount of said Mg.

39. An aluminum alloy as recited in claim 1, further including 0.05–0.20% by weight of Ti.

40. An aluminum alloy as recited in claim 1, further including 0.05–0.30% by weight of Zr.

41. An aluminum alloy as recited in claim 5, further including not more than 0.20% weight of Ti.

42. An aluminum alloy as recited in claim 5, further including 0.05–0.30% by weight of Zr.

43. An aluminum alloy as recited in claim 10, further including 0.05–0.40% weight of Cr.

44. An aluminum alloy as recited in claim 10, further including 0.05–0.30% by weight of Zr.

45. An aluminum alloy as recited in claim 16, further including 0.05–0.40% by weight of Cr.

46. An aluminum alloy as recited in claim 16, further including 0.05–0.30% by weight of Zr.

47. An aluminum alloy as recited in claim 34, further including 0.05–0.40% by weight of Cr.

48. An aluminum alloy as recited in claim 34, further including 0.05–0.30% by weight of Zr.

49. An aluminum alloy as recited in claim 35, further including 0.05–0.40% by weight of Cr.

50. An aluminum alloy as recited in claim 35, further including 0.05–0.30% by weight of Zr.

* * * * *